US008378652B2

(12) United States Patent
Xie

(10) Patent No.: US 8,378,652 B2
(45) Date of Patent: Feb. 19, 2013

(54) LOAD TRANSIENT RESPONSE TIME OF LDOS WITH NMOS OUTPUTS WITH A VOLTAGE CONTROLLED CURRENT SOURCE

(75) Inventor: Yong Xie, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 745 days.

(21) Appl. No.: 12/317,456

(22) Filed: Dec. 23, 2008

(65) Prior Publication Data

US 2010/0156362 A1 Jun. 24, 2010

(51) Int. Cl.
*G05F 1/00* (2006.01)
*G05F 1/565* (2006.01)

(52) U.S. Cl. ..... 323/274; 323/279; 323/280

(58) Field of Classification Search ..... 323/273, 323/274, 275, 279, 280, 315
See application file for complete search history.

(56) References Cited

U.S. PATENT DOCUMENTS 5,867,015 A * 2/1999 Corsi et al. ..... 323/316
6,556,083 B2 * 4/2003 Kadanka ..... 330/292
6,690,147 B2 * 2/2004 Bonto ..... 323/280
6,700,361 B2 * 3/2004 Gregorius ..... 323/282
7,088,082 B2 * 8/2006 Jung ..... 323/275
7,170,352 B1 * 1/2007 Caldwell ..... 330/261
7,218,082 B2 * 5/2007 Walter et al. ..... 323/273
7,268,524 B2 * 9/2007 Kase et al. ..... 323/282
7,557,556 B2 * 7/2009 Nakashimo ..... 323/299
7,589,507 B2 * 9/2009 Mandal ..... 323/273
7,629,711 B2 * 12/2009 Zhong et al. ..... 307/103
7,659,703 B1 * 2/2010 Fesler et al. ..... 323/273
7,902,801 B2 * 3/2011 Mandal ..... 323/273
8,129,962 B2 3/2012 Xie et al.

OTHER PUBLICATIONS

"A User's Guide to Compensating Low-Dropout Regulators," National Semiconductor, pp. 1-14 (Chester Simpson).
"Frequency Compensation," http://en.wikipedia.org/wiki/Frequency_compensation.

* cited by examiner

*Primary Examiner* — Gary L Laxton
*Assistant Examiner* — Zekre Tsehaye
(74) *Attorney, Agent, or Firm* — William B. Kempler; Wade J. Brady, III; Frederick J. Telecky, Jr.

(57) ABSTRACT

A voltage controlled current source circuit is utilized to clamp the internal compensation node of a low dropout (LDO) regulator with an NMOS output during load transients. The circuit senses a voltage drop of the internal node and mirrors its current to the internal node to hold the internal node voltage when the voltage starts to drop low enough to turn off the output transistor.

20 Claims, 3 Drawing Sheets

LOAD TRANSIENT RESPONSE TIME OF LDOS WITH NMOS OUTPUTS WITH A VOLTAGE CONTROLLED CURRENT SOURCE

BACKGROUND

1. Field

The present invention relates generally to voltage regulators and, more particularly, to low dropout regulators.

2. Description of Related Art

Low dropout (LDO) voltage regulators are distinguished from more traditional regulators by their ability to maintain regulation even when there are only small differences between a supply voltage and a load voltage. Thus, "dropout voltage" refers to the difference between the output voltage and the input voltage at which the circuit quits regulation.

Related LDOs may have either an NMOS output transistor or a PMOS output transistor which may be selected based on a number of design considerations. In particular, FIG. 1 depicts a related LDO having an NMOS output transistor. A differential input stage 104 controls two current sources 106, 108 that, respectively, in turn control the gate of the output transistor 114 through a PMOS source-follower 112. A compensation capacitor 110 establishes an internal pole that helps ensure the gain drops low enough before any other internal or external poles are reached thereby assisting in the circuit's stability. The differential input stage 104 includes as its inputs a reference voltage 102 and a feedback signal 124 from between voltage divider resistors 116 and 118. The regulated output voltage 120 drives a load 122 that may include an output capacitor.

In operation, a voltage glitch of the reference voltage 102 may cause an increase of the output voltage. When the glitch goes away, the output voltage also is supposed to return to normal but what may happen is that the control loop will turn off the NMOS output transistor. Because the output capacitor may have a large capacitance, it takes a relatively long time to drain any extra charge when the load current is small. During this relatively long period of time the internal compensation node will also discharge until reaching a ground state.

If, however, another load is applied during this period, it will take time to charge the internal compensation capacitor 110 before the gate of the output transistor 114 is driven high enough to drive an output. In other words, the internal compensation node will have to swing from ground to $V_{OUT}$ 120 which will take time especially if the compensation capacitor 110 is relatively large and the current source is low. This behavior is undesirable and disadvantageous.

Accordingly, there remains an unfilled need in this technology for improvements to LDOs that maximize load transient response times without disadvantageous design choices.

BRIEF SUMMARY

Embodiments of the present invention relate to a voltage controlled current source circuit that is utilized to clamp the internal compensation node of a low dropout (LDO) regulator with an NMOS output during load transients. The circuit senses a voltage drop of the internal node and mirrors its current to the internal node to hold the internal node voltage when the voltage starts to drop low enough to turn off the output transistor.

It is understood that other embodiments of the present invention will become readily apparent to those skilled in the art from the following detailed description, wherein it is shown and described only various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF DRAWINGS

Various aspects of embodiments of the invention are illustrated by way of example, and not by way of limitation, in the accompanying drawings, wherein.

DETAILED DESCRIPTION

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

Figure 1:
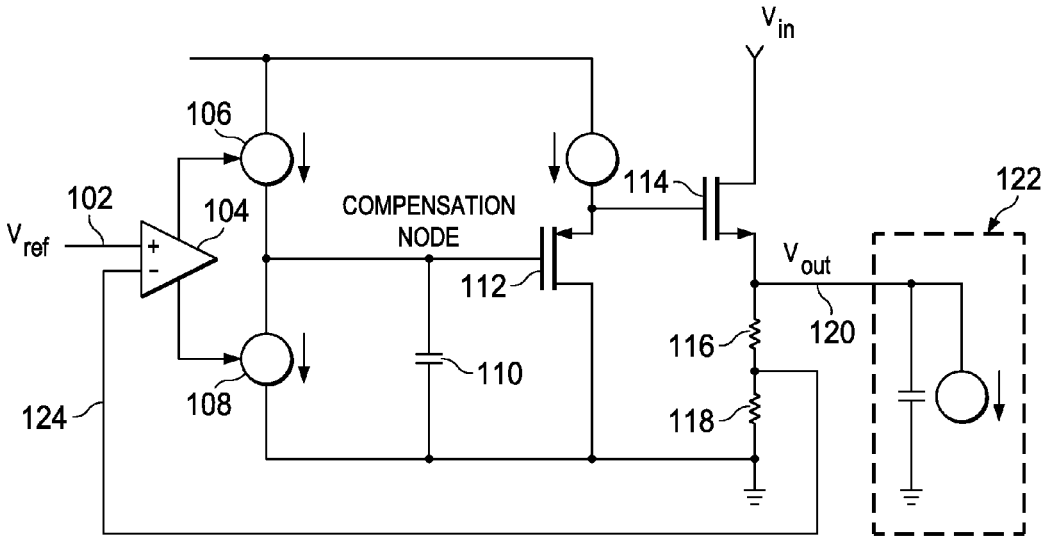
FIG. 1 (PRIOR ART)
FIG. 1 depicts a related low dropout regulator with an NMOS output transistor.
Figure 2:
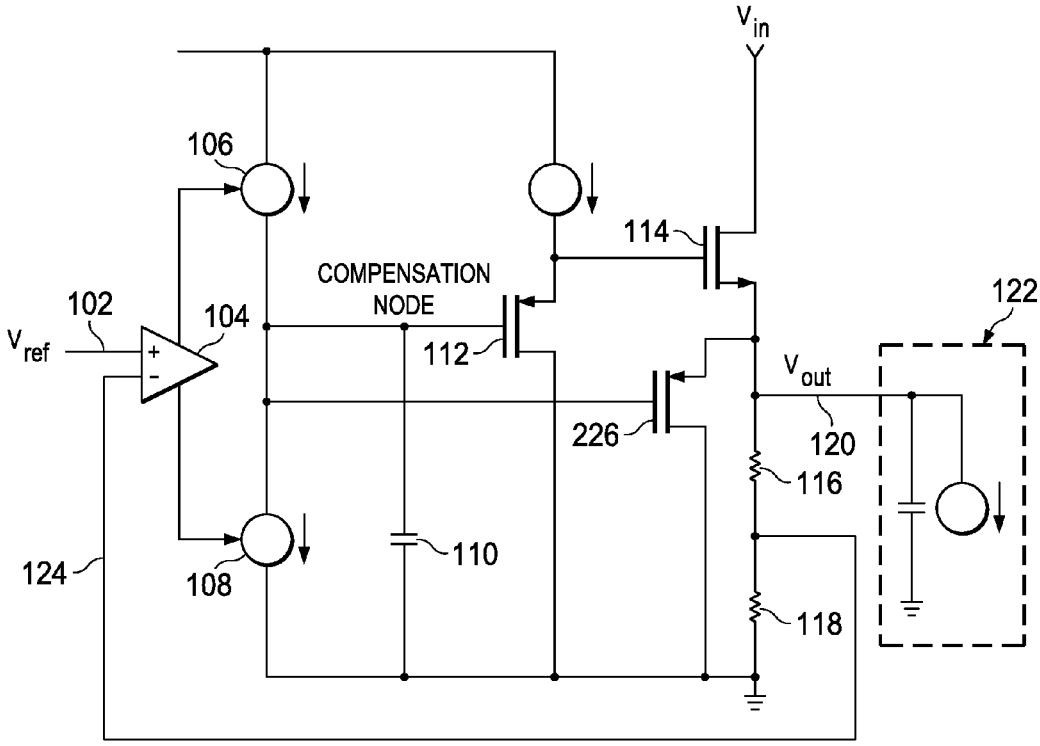
FIG. 2 (RELATED ART)
FIG. 2 depicts a low dropout regulator having a PMOS transistor acting as a load under certain operating conditions.

One related approach for addressing disadvantages of LDO regulators with NMOS output transistors is depicted in FIG. 2. In this approach, a PMOS transistor 226 is utilized to introduce a load at the output whenever the internal compensation node drops too low. For example, when the compensation node is about one the threshold voltage $V_{threshold}$ of the transistor 326 below the output voltage, the PMOS transistor 226 will be turned on and can readily discharge the output. This allows the LDO to return to regulation quicker. However, if the PMOS is not large enough, a large $V_{GS}$ is needed to discharge the output capacitance 122 so that the compensation node may quickly come back to a regular voltage level. As a result, a PMOS transistor may need to be relatively large before providing significant results.

Figure 3:
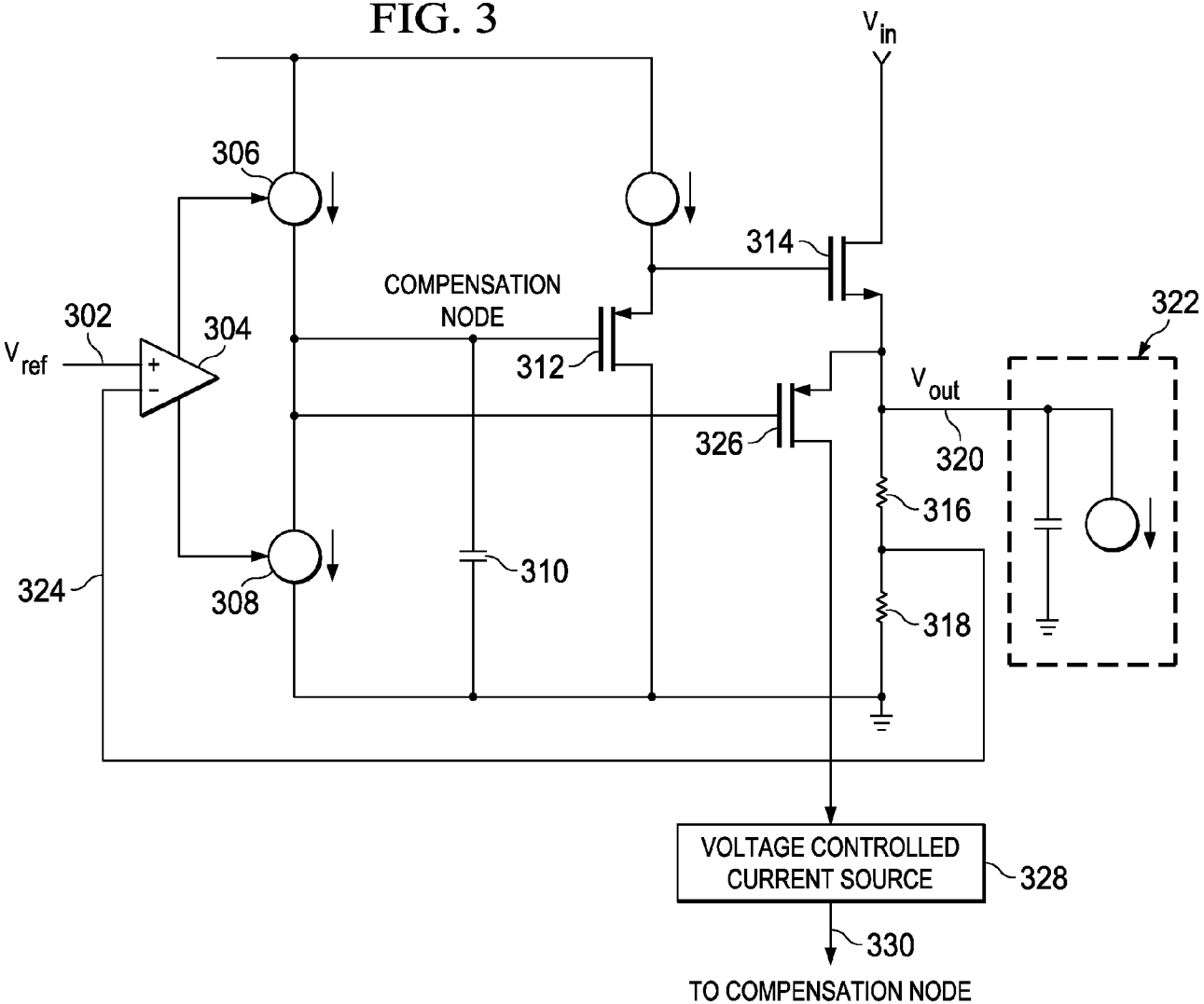
FIG. 3 depicts a low dropout regulator in accordance with embodiments of the present invention.

FIG. 3 depicts a low dropout regulator in accordance with embodiments of the present invention. A differential input stage 304 controls two current sources 306, 308 that, respectively, in turn control the gate of the output transistor 314 through a PMOS source-follower 312. A compensation capacitor 310 (e.g., about 100 pF) helps establishes an internal pole that assists in maintaining the circuit's stability. The differential input stage 304 includes as its inputs a reference voltage 302 and a feedback signal 324 between voltage divider resistors 316 and 318. The regulated output voltage 320 drives a load 322.

The compensation capacitor 310 is coupled between a compensation node and ground. The gate of a PMOS transistor 326 is also electrically coupled with the compensation node and is configured to sense the voltage level at the compensation node. In particular, the PMOS transistor 326 is used to sense a voltage drop at the compensation node. If the compensation node drops more than approximately the threshold voltage $V_{threshold}$ of the transistor 326 below the output voltage 320, the PMOS transistor 326 is turned on.

As shown in FIG. 3, the drain of the PMOS transistor 326 is used to control a voltage controlled current source 328. The output 330 of the voltage controlled current source 328 is fed back to the compensation node so as to act as a clamp on the compensation node. In particular, the current of the PMOS transistor 326, when it is turned on, will be mirrored back to the compensation node to stop its voltage from dropping.

One advantage of the PMOS transistor 326 is that it will substantially match the other PMOS transistor 312 over process variations. At the most troublesome process corner (e.g., weak PMOS, strong NMOS, and at high temperatures), the PMOS sensor transistor 326 will become more difficult to be turned on, which minimizes the current that may be injected into the compensation node by the clamping circuit when the circuit is supposed to stay in regulation and the clamping current is not necessary. Additionally, when the load transients result in the PMOS sensor transistor 326 being turned on, a threshold matching between it and the other PMOS transistor 312 helps set the gate clamping voltage more precisely. For example, only a few microamps may be needed to stop the compensation node from falling, which results in a utilizing a relatively small PMOS transistor that can clamp the compensation node to approximately the output voltage.

Figure 4:
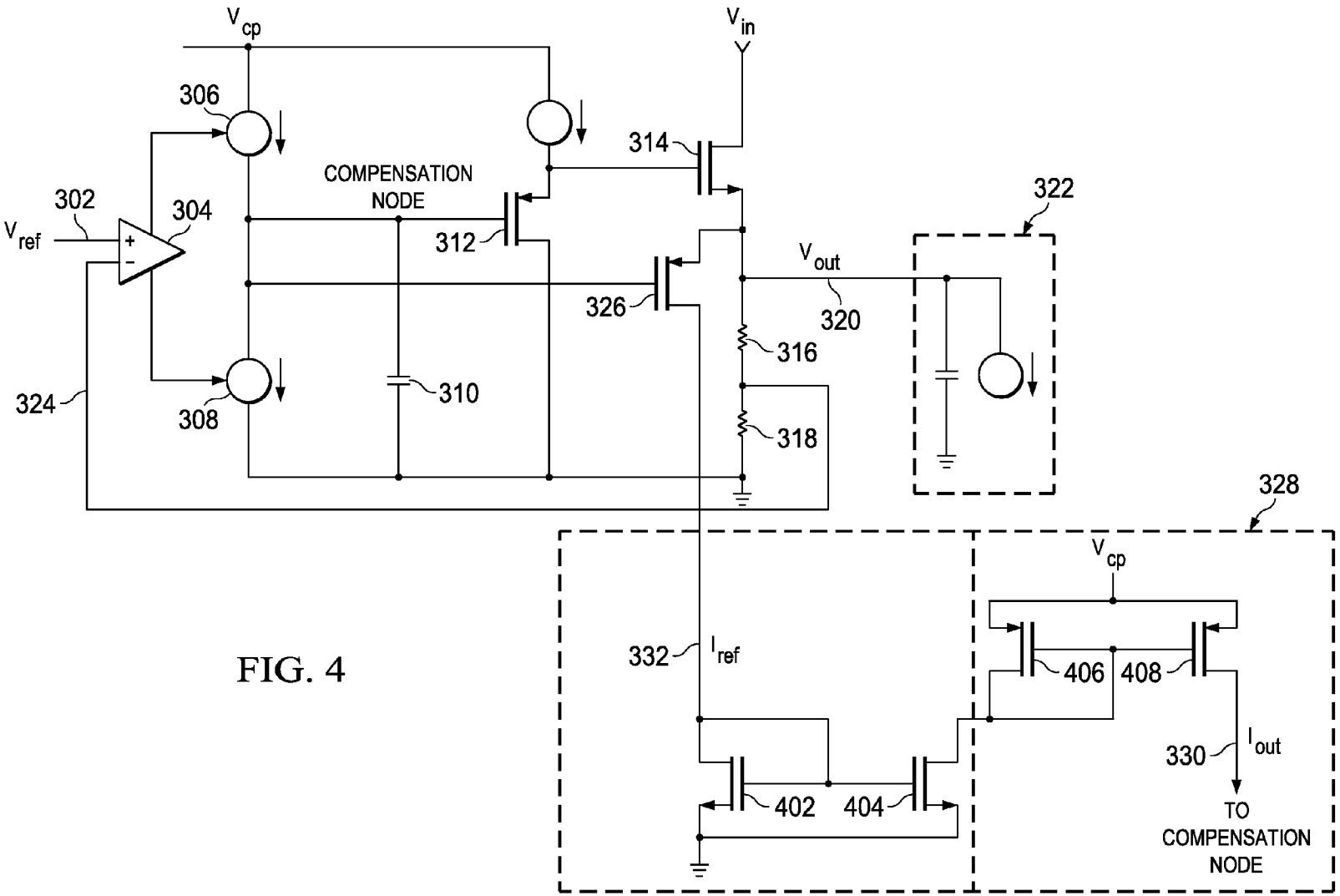
FIG. 4 depicts a low dropout regulator in accordance with embodiments of the present invention.

FIG. 4 depicts circuitry similar to that of FIG. 3 but provides additional details of one example voltage controlled current source 328 that may be utilized to clamp the compensation node as discussed above. In the example current mirror circuitry of FIG. 4, as is known in the art, an input current at the left side pair of transistors of the circuitry 328 is reproduced, or mirrored, in the right side pair of transistors of circuitry 328. In particular to embodiments herein, the current 332 of the PMOS transistor 326 is the input or reference current (e.g., $I_{ref}$) of the mirror and is determined by the voltage sensed at the gate of the PMOS transistor 326. As configured, the current 332 is mirrored as an output current 330 ($I_{out}$). This output current 330 is coupled with the compensation node to clamp its voltage as it starts to drop; thus a voltage controlled current source 328 may be implemented which operates as a voltage clamp on the compensation node. The example current mirror circuitry depicted in FIG. 4 minimizes input impedance and maximizes output impedance; however, one of ordinary skill will recognize that other, functionally equivalent, controllable current sources may be utilized as well without departing from the scope of the present invention.

By way of further explanation, the voltage controlled current source 328 of FIG. 4 includes two NMOS transistors 402, 404 configured in what is commonly referred to as an NMOS simple current mirror that are followed by a pair of PMOS transistors 406,408 configured in what is commonly referred to as a PMOS simple current mirror. The pair of NMOS transistors 402, 404 act as a current sinking mirror that drives the PMOS pair of transistors 406,408 which act as a current sourcing mirror that provides $I_{out}$ 330.

In operation, $I_D$ of transistor 404 mirrors the drain current $I_D$ of the transistor 402 according to the following relationship:

$$I_{D\,404}=I_{D\,402}\,[(W/L)_{404}/(W/L)_{402}]$$

where W and L refer to the channel length and width of the transistor. Thus, the resulting current $I_{D\,404}$ can be controlled to substantially mirror the current $I_{D\,402}$ through transistor 402 by selecting similar process characteristics between the two transistors. In a similar manner, the drain current of transistor 408 mirrors the drain current through transistor 406. As shown in the figure, the current through transistor 406 the main contributor of the drain current of PMOS transistor 406. In a PMOS simple current mirror configuration, $$I_{D\,408}=I_{D\,406}\,[(W/L)_{408}/(W/L)_{406}]$$

Because $I_{OUT}=I_{D\,408}$, the two current mirrors configured as shown in FIG. 4, provide a voltage controlled current source 328 that provides a current $I_{OUT}$ 330, which depends on the voltage of the compensation node, so as to clamp the voltage of the compensation node to $V_{OUT}$.

It is worth noting that simply shorting the drain of the PMOS sensor transistor 326 to the compensation node may have unintended consequences. Its body diode would limit the swing of the compensation node during normal operation. According to the embodiments depicted, the current from the PMOS sensor transistor is turned around and sourced from a supply so that there is no direct current path between the $V_{OUT}$ 320 and the compensation node.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. Also, the term "exemplary" is meant to indicate that some information is being provided as an example only as is not intended to mean that that information is somehow special or preferred. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A low dropout voltage regulator, comprising:

an internal frequency compensation node for maintaining stability from oscillation or ringing of the low dropout regulator;

a sensor coupled between an output of the low dropout regulator and a controllable current source and configured to detect differential voltage changes between an output node and the internal compensation node for clamping a voltage at the internal compensation node to speed up transient response of the low dropout regulator to maintain output voltage; and wherein the controllable current source comprises:

a control input electrically coupled with the sensor, and an output electrically coupled to the internal compensation node.

2. The low dropout voltage regulator of claim 1, further comprising:

an output transistor, configured to provide an output voltage, and electrically coupled with the sensor.

3. The low dropout voltage regulator of claim 1, wherein the controllable current source comprises a voltage controlled current source.

4. The low dropout voltage regulator of claim 1, wherein the internal compensation node includes a compensation capacitor coupled between the internal compensation node and a ground.

5. The low dropout voltage regulator of claim 1, wherein the sensor includes a PMOS sensor transistor.

6. The low dropout voltage regulator of claim 2, wherein the sensor includes a PMOS sensor transistor.

7. The low dropout voltage regulator of claim 6, wherein a gate of the PMOS sensor transistor is electrically coupled with the internal compensation node and a source of the PMOS sensor transistor is electrically coupled with the output voltage.

8. The low dropout voltage regulator of claim 7, wherein the drain of the PMOS sensor transistor is electrically coupled with the input of the controllable current source.

9. The low dropout voltage regulator of claim 2, further comprising:

a differential input stage having a first input related to the output voltage and a second input related to a reference voltage.

10. The low dropout voltage regulator of claim 9, wherein an output of the differential input stage is configured to control a gate of the output transistor.

11. The low dropout voltage regulator of claim 2, further comprising:

a PMOS source follower circuit between the internal compensation node and the output transistor.

12. The low dropout voltage regulator of claim 6, further comprising:

a PMOS source follower circuit between the internal compensation node and the output transistor.

13. The low dropout voltage regulator of claim 12, wherein a gate of the PMOS source follower circuit and a gate of the PMOS sensor transistor are electrically coupled with the internal compensation node.

14. The low dropout voltage regulator of claim 2, wherein the sensor is configured to detect when the voltage of the internal compensation node drops below the output voltage by at least a predetermined threshold.

15. The low dropout voltage regulator of claim 14, wherein:

the sensor comprises a PMOS sensor transistor and the predetermined threshold is approximately $V_{threshold}$ for the PMOS sensor transistor.

16. A low dropout voltage regulator, comprising:

a differential input stage including a first output and a second output;

the first output configured to control a first current source and a second output configured to control a second current source;

a PMOS source follower circuit electrically coupled with the first and second current source, wherein a combination of the first and second current sources is configured to control a gate of an NMOS output transistor through the PMOS source follower circuit;

the NMOS output transistor configured to provide an output voltage relative to a ground voltage;

a frequency compensation capacitor electrically coupled between a compensation node and the ground voltage for maintaining stability from oscillation or ringing, and wherein a gate of the PMOS source follower circuit is electrically coupled with the compensation node;

a PMOS sensor transistor including a gate of the PMOS sensor transistor electrically coupled with the compensation node and a source of the PMOS sensor transistor electrically coupled with the output voltage; and a voltage controllable current source including an input of the voltage controllable current source electrically coupled with a drain of the PMOS sensor transistor, and an output of the voltage controllable current source electrically coupled with the compensation node.

17. A method for operating a low dropout voltage regulator, comprising:

sensing using a sensor coupled between an internal frequency compensation node for maintaining stability from oscillation or ringing of the low dropout regulator and an output of the low dropout regulator;

when a voltage of the internal compensation node falls below an output voltage by at least a predetermined threshold, controlling a voltage controlled current source, using a control input electrically coupled with the sensor, to clamp the voltage of the internal compensation node to substantially the output voltage to speed up transient response of the low dropout regulator to maintain output voltage.

18. The method of claim 17, further comprising:

providing a regulated voltage output through an NMOS output transistor.

19. The method of claim 18, further comprising:

controlling a gate voltage of the NMOS output transistor using a differential input stage that includes a PMOS source follower configuration.

20. The method of claim 17, wherein the step of controlling further includes:

mirroring a current of a PMOS sensing transistor, configured to perform the sensing step, back to the internal compensation node so as to clamp the voltage.

* * * * *